US005258689A

United States Patent [19]

Jansma et al.

[11] Patent Number: 5,258,689

[45] Date of Patent: Nov. 2, 1993

[54] FLUORESCENT LAMPS HAVING REDUCED INTERFERENCE COLORS

[75] Inventors: Jon B. Jansma, University Heights; Thomas G. Parham; Pamela K. Whitman, both of Gates Mills, all of Ohio

[73] Assignee: General Electric Company, Schenectady, N.Y.

[21] Appl. No.: 805,133

[22] Filed: Dec. 11, 1991

[51] Int. Cl.[5] ..... H01J 01/62

[52] U.S. Cl. ..... 313/489; 313/635; 313/493; 313/112

[58] Field of Search ..... 313/489, 490, 487, 491, 313/479, 492, 573, 635, 564, 112, 113, 493

[56] References Cited

U.S. PATENT DOCUMENTS

| | | | |
|---|---|---|---|
| 2,864,966 | 12/1958 | Burns | 313/489 |
| 3,967,153 | 6/1976 | Milke et al. | 313/489 |
| 4,020,385 | 4/1977 | Lagos | 313/489 |
| 4,079,288 | 3/1978 | Maloney et al. | 313/489 |
| 4,363,998 | 12/1982 | Graff et al. | 313/487 |
| 4,379,981 | 4/1983 | Rusch | 313/489 |
| 4,639,637 | 1/1987 | Taubner et al. | 313/489 |
| 5,008,789 | 4/1991 | Arai et al. | 313/489 X |
| 5,045,752 | 9/1991 | Jansma | 313/487 |

*Primary Examiner*—Donald J. Yusko
*Assistant Examiner*—Ashok Patel
*Attorney, Agent, or Firm*—Edward M. Corcoran; Stanley C. Corwin

[57] ABSTRACT

Fluorescent lamps having a tin oxide layer protected by a layer of colloidal alumina having a median particle diameter below 0.4 micron exhibit an objectionable pearlescent coloration if the alumina layer thickness is within the range of 500–8,000 Å. This coloration is reduced to an acceptable level by incorporating from 10–30 wt. % of particulate alumina having a median diameter above 0.75 micron in the colloidal alumina.

7 Claims, 2 Drawing Sheets

FLUORESCENT LAMPS HAVING REDUCED INTERFERENCE COLORS

BACKGROUND OF THE INVENTION

1. Field of the Invention

This invention relates to a fluorescent lamp which does not exhibit objectionable interference colors and which has two different light-transparent layers adjacent the inner glass envelope surface. More particularly, this invention relates to fluorescent lamps having two non-luminescent, light-transparent layers adjacent each other and disposed on the inner surface of the glass envelope, each layer having a different index of refraction with one layer being particulate and having a particle size distribution such that the lamp does not exhibit optical interference colors from said layers.

2. Background of the Disclosure

It is well known in the fluorescent lamp industry that the starting voltage requirement of a fluorescent lamp is influenced by the surface resistance of the inner wall of the lamp envelope or tube. By using a conductive coating disposed adjacent the inner wall surface, the voltage necessary for ignition or starting the arc of a fluorescent lamp is substantially reduced. Most often the conductive coating is tin oxide doped with minor amounts of antimony or fluorine to make the oxide layer electrically conducting, since tin oxide of itself is a semiconductor. Indium oxide has also been used as a conductive coating. However, the use of a conductive coating creates its own problems in that it is somewhat subject to degradation by the mercury arc which cause it to discolor and turn grey during the life of the lamp, resulting in reduced light output. Consequently, it has become common to provide a protective layer on the conductive layer in order to overcome these disadvantages. The protective layer must be continuous, electrically non-conducting, and chemically inert in that it doesn't react with the arc, the phosphor or the mercury and it must also be substantially transparent to light radiation in the visible range. A layer of submicron particle size alumina such as Alon C or Degussa C, finely powdered aluminum oxide having a particle size range of 70–100 nanometers, has been commercially used as a protective layer to overcome the foregoing disadvantages. Other oxides which may and which have been used include metal oxides such as silica, yttria and zirconia. Such protective coatings are generally employed at a thickness within the range of about 500–800 Å and 8,000–10,000 Å, at which thickness they are substantially transparent to the visible light radiation emitted by the lamp. The index of refraction of the conductive layer and that of the protective layer is different since they are different materials which makes the two layer combination act as an optical interference filter producing a visible coloration when the lamp is in an unlit condition. Slight variations in layer thickness can produce a striated, pearlescent effect which some find objectionable. This phenomena is more observable when the lamp is in the unlit condition than when it is in the lit condition. Although this phenomena has always existed, it has not been too objectionable with fluorescent lamps wherein the protective coating is in the range of either 500–800 Å or greater than 6,000 Å.

Lamp manufacturers have recently started manufacturing more compact fluorescent lamps wherein the diameter of the lamp envelope has been substantially reduced for the same light output. This brings the conductive layer closer to the arc discharge. As a consequence, the thickness of the protective layer has been increased to the range of from about 2000–4000 Å which has exacerbated and intensified the optical interference filter coloration effect to the point where some customers will not purchase such lamps. Consequently, there has been a need for fluorescent lamps which do not exhibit this objectionable coloration.

SUMMARY OF THE INVENTION

The present invention relates to a fluorescent lamp having two light-transparent coatings or layers of different refractive index disposed adjacent each other and against the inner surface of the lamp glass envelope wherein one of said layers comprises particles the majority of which have a median diameter below the wavelength of visible light along with a sufficient amount of particles having a diameter greater than the wavelength of light to reduce the ability of said two layers to act as an optical interference filter. By smaller than the wavelength of visible light is meant smaller than about 0.4 microns and by larger is meant larger than about 0.75 micron. This invention is particularly useful with a fluorescent lamp that has a light-transparent conductive coating disposed adjacent the inner surface of the lamp glass envelope over which is disposed a protective layer of particulate, inert metal oxide wherein the majority of said particles have a median particle size smaller than the wavelength of visible light. Thus, in one embodiment the present invention relates to a fluorescent lamp comprising a glass envelope containing an ionizable, discharge-sustaining fill which emits visible light radiation when energized and having (i) a light-transmissive, electrically conductive layer disposed on the inner surface of said envelope with (ii) a protective layer or coating of light-transmissive, electrically non-conductive, inert particulate material disposed on said conductive layer and (iii) at least one layer of phosphor or luminescent material disposed on said protective layer, wherein said protective layer comprises particles the majority of which have a median diameter below the wavelength of visible light radiation along with a sufficient amount of particles having a median diameter greater than the wavelength of light to reduce the ability of said conductive and said protective layers to act together as an optical interference coating, thereby reducing the amount of objectionable coloration exhibited on the surface of said lamp in an unlit condition.

DETAILED DESCRIPTION

Figure 1:
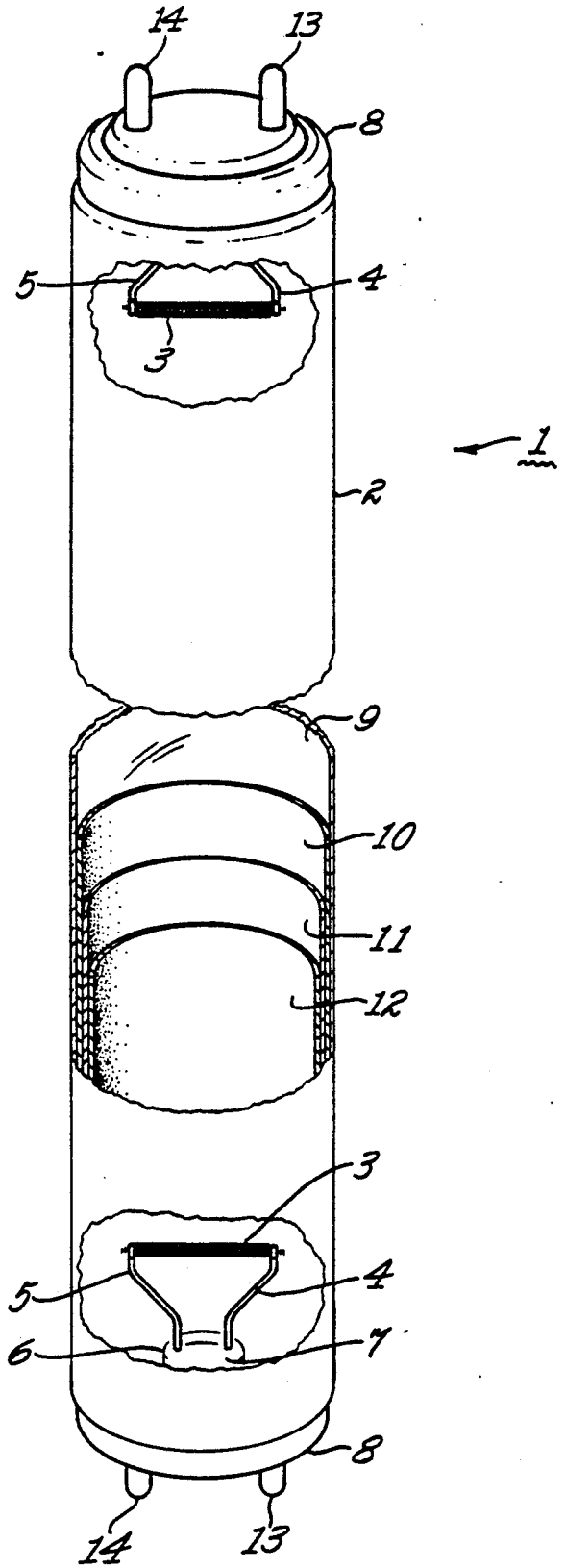
FIG. 1 illustrates in perspective view a partially broken away section of a fluorescent lamp containing a conductive layer, a protective layer and a layer of luminescent material in accordance with the invention.

Referring to FIG. 1, lamp 1 comprises an elongated, hermetically sealed glass envelope 2 having electrodes 3 at each end. Envelope 2 contains a discharge-sustaining fill of mercury, along with an inert, ionizable gas (not shown). Electrodes 3 are connected to inlead wires 4 and 5 which extend through a glass seal 6 in a mount stem 7 to the electrical contacts of a base 8 fixed at both ends of the sealed glass envelope and containing contact pins 13 and 14 which are electrically connected to inleads 4 and 5. The inert gas is a noble gas and will generally be argon or a mixture of argon and krypton at a low pressure of about 1–4 torr. The inert gas acts as a buffer or means for limiting the arc current. Disposed on the inner wall 9 of envelope 2 is a light transparent, conductive layer 10 consisting essentially of tin oxide doped with minor amounts of antimony or fluorine in order to make it electrically conducting, tin oxide of itself being a semiconducting material. The tin oxide layer may be applied employing a spray pyrolysis process wherein a mixture of tin chloride and water are atomized onto the inner wall of the lamp envelope when the lamp envelope is at a temperature of about 600° C. The tin oxide coating is applied at a thickness of about 200–800 Å and has a refractive index of 1.9. It is known to those skilled in the art to apply a tin oxide conductive coating to the inside surface of a fluorescent lamp envelope by a spray or vapor pyrolysis process as is disclosed, for example, in U.S. Pat. No. 4,293,594. The so-deposited tin oxide is not particulate. A light transparent protective layer 11 of particles of inert, electrically non-conductive metal oxide is disposed on conductive layer 10. This protective layer 11 should be substantially continuous in order to adequately protect conductive layer 10 from deterioration by the arc discharge, which means that it will be relatively free of voids or openings such as cracks, holes or other discontinuities which would impair its effectiveness as a protective layer for the conductive coating underneath. By inert is meant that it does not react with, nor is it adversely affected by, the mercury arc discharge, conductive layer, the luminescent material which will comprise one or more phosphors or any of the other components interior of the lamp during the lifetime of the lamp. Suitable metal oxide particles for forming the protective coating include silica, alumina, yttria, and zirconia as illustrative, but non-limiting examples. In one embodiment of the invention protective layer 11 consists essentially of a layer of finely powdered aluminum oxide having a thickness greater than 500 Å and less than 6000 Å. A preferred thickness in accordance with the invention is 2000–4000 Å. Most of the aluminum oxide powder has a median particle diameter less than 0.4 micron, but a sufficient amount of particles having a median diameter greater than 0.75 micron is present to reduce the objectionable coloration effect caused by the combination of layers 10 and 11 acting as an optical interference filter. This has been accomplished in one embodiment by making protective layer 11 a mixture of Degussa C containing from 10–30 wt. % and preferably 10–20 wt. % Baikowski CR30 alumina. If too much of the Baikowski CR30 alumina having a median particle diameter greater than 0.75 micron is added to the Degussa C, it will disrupt the continuity of the protective coating causing voids which diminish its effectiveness as a protective coating for the tin oxide. While not wishing to be held to any theory, it is believed that the larger particles optically "roughen" the protective alumina layer, causing scattering of the reflected light and dulling the interference colors. Since the quality of the protective layer is not significantly changed, its protective properties are not compromised. Degussa C is a high purity, low alkali content, colloidal alumina of submicron particle size dispersible in water and available from the DeGussa Company having a distributor in Teterboro, N.J. Degussa C has a median particle diameter of about 0.2 micron, with the total particle size distribution broadly ranging from about 0.07–1.0 micron, and with 90% of the total distribution occurring (on a measured sample) at less than 0.5 micron. Baikowski CR30, available from the Baikowski International Corporation in Charlotte, N.C., is also a high purity, low alkali content fine alumina powder and has a median particle diameter of 1.0 micron. Particle diameter is meant to include effective particle diameter. The mixture is applied on top of conducting layer 10 as an aqueous suspension as is well known to those skilled in the art. Finally, a layer of phosphor 12 is disposed on protective layer 11. One layer of phosphor, such as a calcium halophosphate phosphor, may be used or multiple layers of phosphor may be used as is well known to those skilled in the art.

A fluorescent lamp such as that shown in FIG. 1 having a conductive tin oxide layer 10 disposed on the inner surface of lamp envelope 2 will exhibit iridescent colors even without protective layer 11 present, because the tin oxide layer has a refractive index of about 1.9 and the glass has a refractive index of about 1.5. Hence, the combination can result in the appearance of iridescent colors to the observer when the lamp is in unlit condition, due to the optical interference effect of the combination of the two light transparent materials of different refractive index. The observed color will vary along the length of the lamp as the thickness of the tin oxide layer varies. However, as long as the tin oxide layer is less than about 1,000 Å thick, these colors are not obvious or objectionable as are those which occur when a protective coating of alumina or other particulate, light transmissive material having a median particle diameter less then 0.4 micron is applied on top of the tin oxide layer at a thickness broadly ranging between 800–6000 Å. Below a protective coating thickness of about 800 Å the problem is not as severe or noticeable. However, such a thin protective layer will not provide adequate protection for the tin oxide layer in the newer fluorescent lamps of reduced diameter. On the other hand, a thickness of about 6000 Å or more also doesn't produce objectionable colors, but increases the cost of the lamp and provides more protection than is needed. A layer of Degussa C or a mixture of Degussa C and Baikowski CR30 alumina has a refractive index of about 1.6 and, at a thickness greater than 800, but less than 6000 Å on top of the tin oxide often results in fluorescent lamps having objectionable coloration because the combination of the tin oxide and alumina layers acts as an optical interference filter adjacent the inner surface of the glass lamp envelope and preferentially reflects light of varying intensity at different wavelengths in the visible spectrum, resulting in an observed coloration on the inner surface of the lamp envelope as streaks of pearlescent colors. The streaks occur due to the fact that the thickness of the protective alumina layer is not absolutely uniform, but varies somewhat due to the nature of the manufacturing process. This has resulted in lamps being rejected by customers due to the iridescent or pearlescent, streaky and blotchy visible appearance of the inner wall surface of the unlit lamp.

Figure 2:
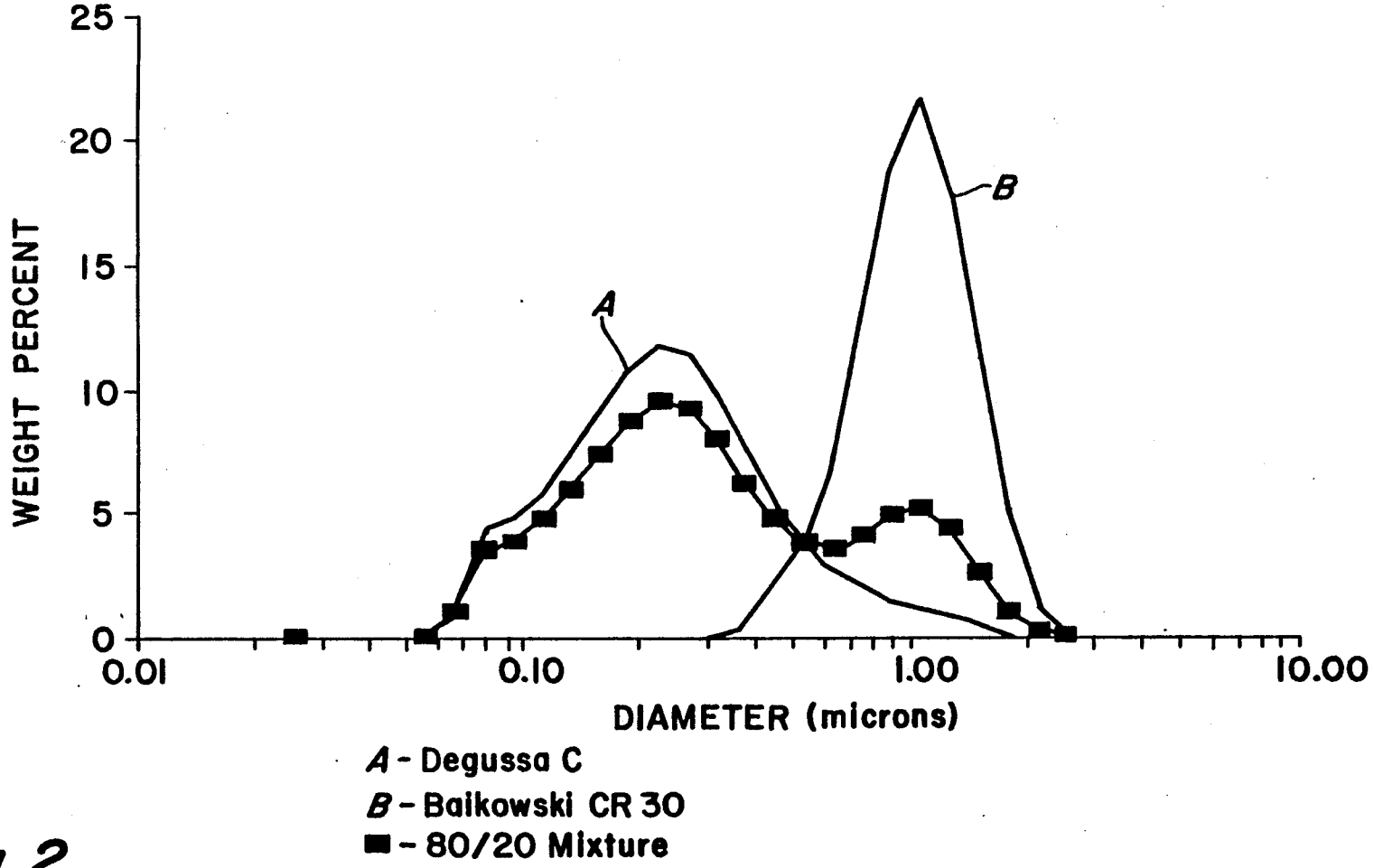
FIG. 2 is a graph illustrating a bimodal particle size distribution for a protective alumina coating according to the invention.

The present invention reduces this appearance defect to an acceptable level by the addition of alumina particles having a median diameter greater than 0.75 micron to the 0.2 micron median particle diameter Degussa C suspension used to form the protective layer. In one embodiment, this has been accomplished by employing, as the protective layer, a mixture of 80 wt. % of DeGussa C alumina and 20 wt. % of Baikowski CR30 alumina. FIG. 2 graphically illustrates the bimodal distribution of the median particle diameter for the 80/20 mixture, along with the distribution for both the Degussa C and the Baikowski CR30. Thus in the bimodal distribution there are two maximas, one having a median particle diameter of 0.2 micron and the other 1.0 micron. A bimodal distribution for the mixture will occur with the CR30 in the 10–30 wt. % range.

Forty watt, four foot long fluorescent lamps were made, as illustrated in FIG. 1, having a nominal diameter of one and one-quarter inches (T10) compared to the more conventional nominal diameter of one and one-half inches (T12). The lamps had a tin oxide layer about 800 Å thick and a protective layer of Degussa C about 3000 Å thick. The phosphor was a standard calcium halophosphate. Without the presence of the CR30 in the protective layer, the lamps exhibited an objectionable pearlescent coloration in an unlit condition. With the additional of 20 wt. % CR30 to the Degussa C the coloration was substantially reduced to a level where it was barely noticeable and which was found to be acceptable.

This invention is not limited to using alumina as a protective layer or to the specific particle sizes referred to herein. The essence of the invention relates to a layer of particles having a size distribution which reduces its effect to act as an optical interference filter in combination with a layer having a different refractive index. In a broader sense, this invention relates to elimination of optical interference effects in particulate thin films.

What is claimed is:

1. A fluorescent lamp comprising a light-transmissive envelope containing an arc-sustaining fill, at least one layer of luminescent material and also having two light-transparent layers of different refractive index disposed adjacent each other and against the inner surface of said envelope wherein one of said light-transparent layers is a protective layer which comprises particles of inert metal oxide the majority of which have a median diameter below the wavelength of visible light along with particles having a diameter greater than the wavelength of visible light radiation, said greater diameter metal oxide particles being present in an amount sufficient to reduce the ability of said two layers to act as an optical interference filter.

2. The lamp of claim 1 wherein both of said light-transparent layers are non-luminescent.

3. The lamp of claim 2 wherein said protective layer has a bimodal particle size distribution.

4. A fluorescent lamp comprising a glass envelope containing an ionizable discharge-sustaining fill which emits visible light radiation when energized and having (i) a light-transmissive, electrically conductive layer disposed on the inner surface of said envelope with (ii) a protective layer of light-transmissive, electrically non-conductive, inert, particulate material comprising metal oxide having a bimodal particle size distribution disposed on said conductive layer and (iii) at least one layer of phosphor or luminescent material disposed on said protective layer wherein said protective layer comprises particles the majority of which have a median diameter below 0.4 microns along with a sufficient amount of larger particles having a median diameter greater than 0.75 microns to reduce the ability of said conductive and said protective layers to act together as an optical interference coating.

5. The lamp of claim 4 wherein said metal oxide particles comprise alumina.

6. A fluorescent lamp comprising a hermetically sealed glass envelope containing an ionizable discharge-sustaining fill which emits visible light radiation when energized and having (i) a light-transmissive, electrically conductive layer disposed on the inner surface of said envelope with (ii) a protective layer of light-transmissive, electrically non-conductive, inert particulate material disposed on said conductive layer and (iii) at least one layer of phosphor or luminescent material disposed on said protective layer, wherein said protective layer has a bimodal particle size distribution and comprises a mixture of particles the majority of which have a median diameter below 0.4 micron along with a sufficient amount of particles having a median diameter greater than 0.75 micron to reduce the ability of said conductive and said protective layers to act together as an optical interference coating.

7. The lamp of claim 6 wherein the median particle diameter of said particles having a diameter smaller than 0.4 micron is about 0.2 micron.

* * * * *